US010100537B1

(12) United States Patent
Guinn

(10) Patent No.: US 10,100,537 B1
(45) Date of Patent: Oct. 16, 2018

(54) VENTILATED HIGH CAPACITY HYDRAULIC RIDING TROWEL

(71) Applicant: Allen Engineering Corporation, Paragould, AR (US)

(72) Inventor: Timmy Don Guinn, Paragould, AR (US)

(73) Assignee: Allen Engineering Corporation, Paragould, AR (US)

( * ) Notice: Subject to any disclaimer, the term of this patent is extended or adjusted under 35 U.S.C. 154(b) by 0 days.

(21) Appl. No.: 15/982,764

(22) Filed: May 17, 2018

Related U.S. Application Data

(60) Provisional application No. 62/522,506, filed on Jun. 20, 2017.

(51) Int. Cl.
*E01C 19/42* (2006.01)
*E04F 21/24* (2006.01)

(52) U.S. Cl.
CPC ..... *E04F 21/247* (2013.01); *E01C 19/42* (2013.01)

(58) Field of Classification Search
CPC ..... E04F 21/247; E01C 19/42
USPC ..... 404/112
See application file for complete search history.

(56) References Cited

U.S. PATENT DOCUMENTS 413,846 A 10/1889 Chambers
910,073 A 1/1909 Lischke
954,266 A 4/1910 Doud
985,214 A 2/1911 Shroyer
1,062,613 A 5/1913 Smith
1,105,502 A 7/1914 Fain
1,200,393 A 10/1916 Neller
1,302,275 A 4/1919 Morgan, Jr.
1,364,605 A 1/1921 Powell
1,532,841 A 4/1925 Stayton
1,591,593 A 7/1926 Weller
1,705,502 A 3/1929 Schellentrager
1,719,540 A 7/1929 Franks
1,719,650 A 7/1929 Chamberlain
1,724,043 A 8/1929 Robb
1,736,413 A 11/1929 Lightenberg
1,736,538 A 11/1929 Kurtz
1,743,114 A 1/1930 Carr
1,746,410 A 2/1930 Tolman, Jr.
1,747,555 A 2/1930 Pelton
(Continued)

*Primary Examiner* — Raymond W Addie
(74) *Attorney, Agent, or Firm* — Stephen D. Carver

(57) ABSTRACT

A high performance, multiple rotor, hydraulically driven riding trowel for finishing concrete includes a rigid trowel frame with two or more downwardly-projecting, bladed rotor assemblies that frictionally engage the concrete surface while supporting the trowel. The rotor assemblies are tilted with double acting hydraulic cylinders to effectuate steering and control. A seating arrangement supports an operator. A special ventilation path is provided to prevent overheating of the operator area. cooling compartment adjacent the seating region, Pathways are established by a cooling compartment enclosed by a shroud having at least one side ventilation orifice, a cooler assembly disposed within the cooling compartment; the cooler assembly comprising a grill, a plenum with a heat exchanger adjacent said grill and a fan adjacent said heat exchanger, the plenum having open sides and a closed bottom to prevent air pathways through the seating region.

1 Claim, 14 Drawing Sheets

(56) References Cited

U.S. PATENT DOCUMENTS

| | | | |
|---|---|---|---|
| 1,760,596 | A | 5/1930 | Heltzel |
| 1,768,663 | A | 7/1930 | Carr |
| 1,833,989 | A | 12/1931 | Debnam |
| 1,858,645 | A | 5/1932 | Smoot |
| 1,894,408 | A | 1/1933 | McKenzie |
| 1,898,158 | A | 2/1933 | Winkler |
| 1,909,458 | A | 5/1933 | Dieckmann |
| 1,939,007 | A | 12/1933 | Heltzel |
| 1,974,013 | A | 9/1934 | Clausen |
| 2,006,316 | A | 6/1935 | Mandt |
| 2,025,703 | A | 12/1935 | Baily |
| 2,030,315 | A | 2/1936 | Noble |
| 2,038,416 | A | 4/1936 | Clifford |
| 2,094,910 | A | 10/1937 | Baily |
| 2,113,503 | A | 4/1938 | Blakesley |
| 2,148,214 | A | 2/1939 | Mall |
| 2,223,734 | A | 12/1940 | Mall |
| 2,233,734 | A | 12/1940 | Mall |
| 2,233,833 | A | 3/1941 | Jackson |
| 2,333,833 | A | 3/1941 | Jackson |
| 2,248,103 | A | 7/1941 | Mall |
| 2,261,659 | A | 11/1941 | Pierce |
| 2,292,733 | A | 8/1942 | Baily |
| 2,314,985 | A | 3/1943 | Jackson |
| 2,318,054 | A | 5/1943 | Delaney |
| 2,346,378 | A | 4/1944 | Jackson |
| 2,346,379 | A | 4/1944 | Jackson |
| 2,380,435 | A | 7/1945 | Heltzel |
| 2,382,096 | A | 8/1945 | Pierce |
| 2,439,620 | A | 4/1948 | Faber |
| 2,449,710 | A | 9/1948 | Miller |
| 2,461,500 | A | 2/1949 | Miller |
| 2,468,836 | A | 5/1949 | Persson |
| 2,473,961 | A | 6/1949 | Mandt |
| 2,542,979 | A | 2/1951 | Barnes |
| 2,545,979 | A | 2/1951 | Barnes |
| 2,583,108 | A | 1/1952 | Lewis |
| 2,586,472 | A | 2/1952 | McKown |
| 2,599,330 | A | 6/1952 | Jackson |
| 2,603,132 | A | 7/1952 | Miller |
| 2,651,980 | A | 9/1953 | Wells |
| 2,663,231 | A | 12/1953 | Wood |
| 2,673,725 | A | 3/1954 | Coates |
| 2,693,136 | A | 11/1954 | Barnes |
| 2,700,256 | A | 1/1955 | Lewis |
| 2,746,336 | A | 5/1956 | Reed |
| 2,757,588 | A | 8/1956 | Pollitz |
| 2,789,485 | A | 4/1957 | Lindgren |
| 2,806,435 | A | 9/1957 | Mundell |
| 2,813,466 | A | 11/1957 | Torgerson |
| 2,832,273 | A | 4/1958 | Calabrese |
| 2,866,394 | A | 12/1958 | Smith |
| 2,869,442 | A | 1/1959 | Mincher |
| 2,874,621 | A | 2/1959 | Mentes |
| 2,898,826 | A | 8/1959 | Livermont |
| 2,906,438 | A | 9/1959 | Carpenter |
| 2,914,994 | A | 12/1959 | Pollitz |
| 2,936,907 | A | 5/1960 | Woodruff |
| 2,957,396 | A | 10/1960 | Bederman |
| 2,965,987 | A | 12/1960 | Graves |
| 2,976,784 | A | 3/1961 | Perkins |
| 2,983,203 | A | 5/1961 | Fletcher |
| 2,985,555 | A | 5/1961 | Sherbrook |
| 2,986,419 | A | 5/1961 | Barenyi |
| 2,989,930 | A | 6/1961 | Flowers |
| 3,007,378 | A | 11/1961 | Thieme |
| 3,009,400 | A | 11/1961 | Gerber |
| 3,029,714 | A | 4/1962 | Creswell |
| 3,042,366 | A | 7/1962 | Wyzenbeek |
| 3,042,386 | A | 7/1962 | Wyzenbeck |
| 3,043,201 | A | 7/1962 | Maxon, Jr. |
| 3,051,062 | A | 8/1962 | Apel |
| 3,059,357 | A | 10/1962 | Irish |
| 3,095,789 | A | 7/1963 | Melvin |
| 3,110,234 | A | 11/1963 | Oster |
| 3,113,494 | A | 12/1963 | Barnes |
| 3,118,353 | A | 1/1964 | Neil |
| 3,125,935 | A | 3/1964 | McCandless |
| 3,135,178 | A | 6/1964 | Guntert |
| 3,137,219 | A | 6/1964 | Hudis |
| 3,164,072 | A | 1/1965 | Blankenship |
| 3,180,625 | A | 4/1965 | Wyzenbeck |
| 3,188,054 | A | 6/1965 | Mason, Jr. |
| 3,210,710 | A | 10/1965 | Amos |
| 3,220,322 | A | 11/1965 | Lewis |
| 3,242,835 | A | 3/1966 | Paramythioti |
| 3,243,023 | A | 3/1966 | Boyden |
| 3,251,281 | A | 5/1966 | Iannetti |
| 3,256,788 | A | 6/1966 | Schweihofer |
| 3,259,754 | A | 7/1966 | Matheson |
| 3,262,378 | A | 7/1966 | Shcrimper |
| 3,267,452 | A | 8/1966 | Wolf |
| 3,299,786 | A | 1/1967 | Godbersen |
| 3,347,787 | A | 10/1967 | Rhodes |
| 3,357,745 | A | 12/1967 | Cooper |
| 3,377,933 | A | 4/1968 | Dale |
| 3,385,552 | A | 5/1968 | Drasek |
| 3,403,609 | A | 10/1968 | Bradshaw |
| 3,412,657 | A | 11/1968 | Colizza |
| 3,412,658 | A | 11/1968 | Griffin |
| 3,414,143 | A | 12/1968 | Scott |
| 3,415,173 | A | 12/1968 | Paul |
| 3,418,902 | A | 12/1968 | Wilson |
| 3,435,740 | A | 4/1969 | McGall |
| 3,450,011 | A | 6/1969 | Goobersen |
| 3,453,988 | A | 7/1969 | Trent |
| 3,458,885 | A | 8/1969 | Danielsson |
| 3,515,043 | A | 6/1970 | Austin |
| 3,515,313 | A | 6/1970 | Siems |
| 3,523,494 | A | 8/1970 | Kramer |
| 3,528,348 | A | 9/1970 | Rowe |
| 3,532,032 | A | 10/1970 | Weber |
| 3,540,360 | A | 11/1970 | Snow, Jr. |
| 3,541,931 | A | 11/1970 | Goobersen |
| 3,547,014 | A | 12/1970 | Austin |
| 3,550,812 | A | 12/1970 | Brown |
| 3,554,291 | A | 1/1971 | Rogers |
| 3,555,983 | A | 1/1971 | Swisher, Jr. et al. |
| 3,559,544 | A | 2/1971 | Miller |
| 3,564,986 | A | 2/1971 | Burgin |
| 3,572,227 | A | 3/1971 | Poulsen |
| 3,585,912 | A | 6/1971 | Danielsson |
| 3,593,627 | A | 7/1971 | Rowe |
| 3,593,802 | A | 7/1971 | DeLange, Jr. |
| 3,596,565 | A | 8/1971 | Atkinson |
| 3,605,577 | A | 9/1971 | Bik |
| 3,656,848 | A | 4/1972 | Welden |
| 3,663,060 | A | 5/1972 | Shatwell |
| 3,665,820 | A | 5/1972 | Rasmussen |
| 3,680,451 | A | 8/1972 | Birchet |
| 3,702,758 | A | 11/1972 | Davin |
| 3,712,189 | A | 1/1973 | Birtchet |
| 3,738,763 | A | 6/1973 | Glesmann |
| 3,747,981 | A | 7/1973 | Zuzelo |
| 3,753,621 | A | 8/1973 | Dale |
| 3,778,110 | A | 12/1973 | Staab |
| 3,797,953 | A | 3/1974 | Lindskog |
| 3,799,607 | A | 3/1974 | Shakespear |
| 3,801,211 | A | 4/1974 | Perkins |
| 3,838,932 | A | 10/1974 | Glenewinkel |
| 3,844,417 | A | 10/1974 | Holm |
| 3,868,200 | A | 2/1975 | Bratchell |
| 3,877,830 | A | 4/1975 | James, III |
| 3,883,259 | A | 5/1975 | Berg |
| RE28,561 | E | 9/1975 | Stephens |
| 3,907,451 | A | 9/1975 | Fisher |
| 3,936,121 | A | 2/1976 | Leinberger |
| 3,936,209 | A | 2/1976 | Krage |
| 3,936,212 | A | 2/1976 | Holz, Sr. |
| 3,957,384 | A | 5/1976 | Lamb |
| 3,973,857 | A | 8/1976 | Whiteman, Jr. |
| 4,012,160 | A | 3/1977 | Parker |
| 4,015,734 | A | 4/1977 | Laidig |
| 4,027,991 | A | 6/1977 | Maass |

(56) References Cited

U.S. PATENT DOCUMENTS

| | | | |
|---|---|---|---|
| 4,030,873 | A | 6/1977 | Morrison |
| 4,046,483 | A | 9/1977 | Sutherland |
| 4,046,484 | A | 9/1977 | Holz, Sr. |
| D246,814 | S | 1/1978 | Peggs |
| 4,068,969 | A | 1/1978 | Beach |
| 4,068,970 | A | 1/1978 | Rowe |
| 4,095,705 | A | 6/1978 | Hood |
| 4,105,355 | A | 8/1978 | King |
| 4,115,976 | A | 9/1978 | Rohrer |
| 4,128,359 | A | 12/1978 | Cooper, Jr. |
| 4,132,492 | A | 1/1979 | Jenkins |
| 4,142,815 | A | 3/1979 | Mitchell |
| 4,145,086 | A | 3/1979 | Ishirhara |
| 4,157,769 | A | 6/1979 | Radel |
| 4,188,934 | A | 2/1980 | Reinhardt |
| 4,198,178 | A | 4/1980 | Carlstrom |
| 4,208,151 | A | 6/1980 | Cross |
| 4,213,749 | A | 7/1980 | Morrison |
| 4,229,118 | A | 10/1980 | Kisling |
| 4,232,980 | A | 11/1980 | Tertinek |
| 4,249,327 | A | 2/1981 | Allen |
| 4,253,778 | A | 3/1981 | Morrison |
| 4,256,415 | A | 3/1981 | Rowe |
| 4,256,416 | A | 3/1981 | Bishop |
| 4,282,978 | A | 8/1981 | Zambon |
| 4,312,603 | A | 1/1982 | Whiteman, Jr. |
| 4,314,773 | A | 2/1982 | Allen |
| 4,316,715 | A | 2/1982 | Allen |
| D263,303 | S | 3/1982 | Allshouse |
| 4,320,986 | A | 3/1982 | Morrison |
| 4,320,987 | A | 3/1982 | Rowe |
| 4,335,797 | A | 6/1982 | Simmons |
| 4,335,976 | A | 6/1982 | Morrison |
| 4,340,351 | A | 7/1982 | Owens |
| 4,349,294 | A | 9/1982 | Allen |
| 4,349,328 | A | 9/1982 | Allen |
| 4,358,123 | A | 11/1982 | Richards |
| 4,363,618 | A | 12/1982 | Allen |
| D267,800 | S | 2/1983 | Tate |
| 4,371,330 | A | 2/1983 | Heffernan |
| 4,375,351 | A | 3/1983 | Allen |
| 4,386,695 | A | 6/1983 | Olson |
| 4,386,901 | A | 6/1983 | Morrison |
| 4,388,017 | A | 6/1983 | Morrison |
| 4,397,580 | A | 8/1983 | Morrison |
| 4,397,626 | A | 8/1983 | Morrison |
| 4,398,737 | A | 8/1983 | Harding |
| 4,411,554 | A | 10/1983 | Gratzfeld |
| 4,412,803 | A | 11/1983 | Allen |
| 4,427,358 | A | 1/1984 | Stilwell |
| 4,431,336 | A | 2/1984 | Nightengale |
| 4,446,784 | A | 5/1984 | Gurak |
| 4,466,757 | A | 8/1984 | Allen |
| 4,484,834 | A | 11/1984 | Rowe |
| 4,496,265 | A | 1/1985 | Fragale |
| 4,502,813 | A | 3/1985 | Hojberg |
| 4,538,166 | A | 8/1985 | Nakano |
| 4,540,312 | A | 9/1985 | Allen |
| 4,541,750 | A | 9/1985 | Owens |
| 4,544,346 | A | 10/1985 | Allen |
| 4,553,731 | A | 11/1985 | Carpenter |
| 4,555,200 | A | 11/1985 | Morrison |
| 4,556,339 | A | 12/1985 | Morrison |
| 4,570,960 | A | 2/1986 | Peetz |
| 4,572,704 | A | 2/1986 | Allen |
| 4,577,395 | A | 3/1986 | Shibata |
| 4,577,993 | A | 3/1986 | Allen |
| 4,577,994 | A | 3/1986 | Miller |
| 4,591,291 | A | 5/1986 | Owens |
| 4,607,979 | A | 8/1986 | Morrison |
| 4,614,486 | A | 9/1986 | Bragagnini |
| 4,621,375 | A | 11/1986 | Simnovec |
| 4,629,359 | A | 12/1986 | Sengupta |
| 4,630,964 | A | 12/1986 | Allen |
| D288,912 | S | 3/1987 | Lucas |
| 4,648,741 | A | 3/1987 | Allen |
| 4,650,366 | A | 3/1987 | Morrison |
| 4,657,268 | A | 4/1987 | Colson |
| 4,657,431 | A | 4/1987 | Morrison |
| 4,659,054 | A | 4/1987 | Allen |
| 4,673,311 | A | 6/1987 | Whiteman, Jr. |
| 4,676,690 | A | 6/1987 | Allen |
| 4,676,691 | A | 6/1987 | Morrison |
| 4,685,826 | A | 8/1987 | Allen |
| D291,198 | S | 9/1987 | Yates |
| 4,697,951 | A | 10/1987 | Allen |
| 4,702,640 | A | 10/1987 | Allen |
| 4,702,642 | A | 10/1987 | Musil |
| 4,704,368 | A | 11/1987 | Goth |
| 4,708,520 | A | 11/1987 | Rowe |
| 4,710,054 | A | 12/1987 | Allen |
| 4,710,055 | A | 12/1987 | Maass |
| 4,741,643 | A | 5/1988 | Allen |
| 4,752,154 | A | 6/1988 | Valentine |
| 4,752,156 | A | 6/1988 | Owens |
| 4,769,201 | A | 9/1988 | Chiuminatta |
| 4,773,306 | A | 9/1988 | Dirkin |
| 4,755,262 | A | 10/1988 | Guntharp |
| 4,775,262 | A | 10/1988 | Guntharp |
| 4,775,306 | A | 10/1988 | Kikuchi |
| 4,784,519 | A | 11/1988 | Artzberger |
| 4,795,332 | A | 1/1989 | Davis |
| 4,798,494 | A | 1/1989 | Allen |
| 4,798,794 | A | 1/1989 | Ogura |
| 4,818,140 | A | 4/1989 | Carlson |
| 4,838,730 | A | 6/1989 | Owens |
| 4,840,431 | A | 6/1989 | Jedick |
| 4,848,114 | A | 8/1989 | Heath |
| 4,854,769 | A | 8/1989 | Fukukawa |
| 4,859,114 | A | 8/1989 | Artzberger |
| 4,861,169 | A | 8/1989 | Fukukawa |
| 4,889,675 | A | 12/1989 | Chiuminatta |
| 4,920,698 | A | 5/1990 | Friese |
| 4,928,662 | A | 5/1990 | Chiuminatta |
| 4,929,201 | A | 5/1990 | Pitt |
| 4,930,935 | A | 6/1990 | Quenzi |
| 4,931,008 | A | 6/1990 | Morrison |
| 4,934,864 | A | 6/1990 | Mauldin |
| 4,938,201 | A | 7/1990 | Chiuminatta |
| 4,964,754 | A | 10/1990 | Garner |
| 4,977,928 | A | 12/1990 | Smith |
| 4,978,246 | A | 12/1990 | Quenzi |
| D314,578 | S | 2/1991 | Morrison |
| 5,024,384 | A | 6/1991 | Redmon |
| 5,039,249 | A | 8/1991 | Hansen |
| 5,046,889 | A | 9/1991 | Sterner, Jr. |
| 5,056,499 | A | 10/1991 | Chiuminatta |
| D323,510 | S | 1/1992 | Allen |
| 5,086,750 | A | 2/1992 | Chiuminatta |
| 5,088,799 | A | 2/1992 | Redmon |
| 5,096,753 | A | 3/1992 | McCue |
| 5,108,220 | A | 4/1992 | Allen |
| 5,129,708 | A | 7/1992 | Swan |
| 5,129,803 | A | 7/1992 | Nomura |
| 5,130,794 | A | 7/1992 | Ritchey |
| 5,167,215 | A | 12/1992 | Harding, Jr. |
| 5,190,396 | A | 3/1993 | Aoyagi |
| 5,190,401 | A | 3/1993 | Wilson |
| 5,221,156 | A | 6/1993 | Martin |
| 5,238,323 | A | 8/1993 | Allen |
| D340,340 | S | 10/1993 | Allen |
| D342,180 | S | 12/1993 | Kirlin |
| 5,281,050 | A | 1/1994 | Howard |
| 5,288,166 | A | 2/1994 | Allen |
| D344,736 | S | 3/1994 | Allen |
| 5,328,295 | A | 7/1994 | Allen |
| D350,104 | S | 8/1994 | Lee |
| 5,337,852 | A | 8/1994 | Kastner |
| 5,344,254 | A | 9/1994 | Sartain |
| 5,352,063 | A | 10/1994 | Allen |
| 5,405,216 | A | 4/1995 | Allen |
| 5,408,258 | A | 4/1995 | Kolessar |
| 5,429,494 | A | 7/1995 | Kuehn |
| 5,456,549 | A | 10/1995 | Paladeni |

(56) References Cited

U.S. PATENT DOCUMENTS

| | | | |
|---|---|---|---|
| 5,467,342 | A | 12/1995 | Allen |
| 5,480,257 | A | 1/1996 | Allen |
| 5,480,258 | A | 1/1996 | Allen |
| 5,492,432 | A | 2/1996 | Eben |
| 5,503,232 | A | 4/1996 | Matusushita |
| 5,513,940 | A | 5/1996 | Florentin |
| 5,520,862 | A | 5/1996 | Face, Jr. |
| 5,521,175 | A | 6/1996 | Face, Jr. |
| 5,533,830 | A | 7/1996 | Barichello |
| 5,533,831 | A | 7/1996 | Allen |
| 5,549,413 | A | 8/1996 | Bolden |
| 5,562,361 | A | 10/1996 | Allen |
| 5,567,075 | A | 10/1996 | Allen |
| 5,575,271 | A | 11/1996 | Chiuminatta |
| 5,584,598 | A | 12/1996 | Watanabe |
| D377,927 | S | 2/1997 | Kreidt |
| 5,613,801 | A | 3/1997 | Allen |
| 5,658,089 | A | 8/1997 | Allen |
| 5,664,637 | A | 9/1997 | Ohta |
| 5,683,767 | A | 11/1997 | Shiraki |
| 5,685,667 | A | 11/1997 | Allen |
| 5,690,567 | A | 11/1997 | DeNijs |
| 5,803,658 | A | 9/1998 | Allen |
| 5,816,739 | A | 10/1998 | Allen |
| 5,816,740 | A | 10/1998 | Jaszkowiak |
| D400,542 | S | 11/1998 | Allen |
| D400,544 | S | 11/1998 | Allen |
| D402,998 | S | 12/1998 | Allen |
| D402,999 | S | 12/1998 | Allen |
| D403,332 | S | 12/1998 | Allen |
| D404,041 | S | 1/1999 | Allen |
| D404,042 | S | 1/1999 | Allen |
| 5,887,401 | A | 3/1999 | Moore, Jr. |
| 5,890,833 | A | 4/1999 | Allen |
| D410,931 | S | 6/1999 | Allen |
| D413,127 | S | 8/1999 | Allen |
| 5,934,823 | A | 8/1999 | Allen |
| 5,967,696 | A | 10/1999 | Allen |
| D416,564 | S | 11/1999 | Allen |
| 5,988,938 | A | 11/1999 | Allen |
| 5,988,939 | A | 11/1999 | Allen |
| 6,019,433 | A | 2/2000 | Allen |
| 6,019,545 | A | 2/2000 | Allen |
| 6,048,130 | A | 4/2000 | Allen |
| 6,053,660 | A | 4/2000 | Allen |
| 6,059,299 | A | 5/2000 | Rust |
| 6,075,310 | A | 6/2000 | Bishop |
| 6,087,786 | A | 7/2000 | Allen |
| 6,089,786 | A | 7/2000 | Allen |
| 6,089,787 | A | 7/2000 | Allen |
| 6,101,880 | A | 8/2000 | Face, Jr. |
| 6,106,193 | A | 8/2000 | Allen |
| 6,150,752 | A | 11/2000 | Bishop |
| D453,344 | S | 2/2002 | Smith |
| 6,409,422 | B1 | 6/2002 | Mittermaier |
| D465,897 | S | 11/2002 | Smith |
| D466,909 | S | 12/2002 | Allen |
| D474,203 | S | 5/2003 | Allen |
| 6,582,153 | B1 | 6/2003 | Allen |
| 6,695,532 | B2 | 2/2004 | Somero |
| 6,758,631 | B2 | 7/2004 | Frankeny, II |
| 6,857,815 | B2 | 2/2005 | Allen |
| 6,988,851 | B2 | 1/2006 | Sina |
| 7,059,801 | B2 | 6/2006 | Snyder |
| 7,104,725 | B1 | 9/2006 | Kipp |
| 7,108,449 | B1 | 9/2006 | Allen |
| 7,114,876 | B1 | 10/2006 | Allen |
| 7,201,357 | B2 | 4/2007 | Sina |
| 7,204,659 | B2 | 4/2007 | Schmitt |
| 8,360,680 | B2 | 1/2013 | Allen |
| 9,068,300 | B2 | 6/2015 | Allen |
| 9,631,378 | B1 * | 4/2017 | Grahl ..... E04F 21/247 |

* cited by examiner

VENTILATED HIGH CAPACITY HYDRAULIC RIDING TROWEL

CROSS REFERENCE TO RELATED APPLICATION

This utility patent application is based upon, and claims priority from, U.S. Provisional Patent Application Ser. No. 62/522,506, filed Jun. 20, 2017 and entitled "High Capacity Hydraulic Riding Trowel" by inventor Timmy D. Guinn.

BACKGROUND OF THE INVENTION

I. Field of the Invention

The present invention relates generally to hydraulically-powered, multiple rotor, riding trowels operated with multiple hydraulic control circuits and accompanying software. More particularly, the present invention relates to the ventilation of a high performance riding trowel of the general type classified in USPC 404, Subclass 112.

II. Description of the Prior Art

High power, multiple rotor, hydraulic riding trowels for finishing concrete are well recognized by those skilled in the art. Proper finishing insures that desired surface characteristics including appropriate smoothness and flatness are achieved. It is also important that delamination be minimized. High power, hydraulically driven riding trowels are capable of finishing large areas of plastic concrete quickly and efficiently, while insuring high quality surface characteristics.

Modern hydraulic power riding trowels comprise two or more bladed rotors that project downwardly and frictionally contact the concrete surface. In advanced machines the rotors are driven hydraulically from hydraulic drive motors pressured by hydraulic pumps that are in turn powered by a separate, internal combustion engine. The riding trowel operator sits on top of the frame and controls trowel movement with a joystick steering system that tilts the rotors for control. The weight of the trowel and the operator is transmitted frictionally to the concrete by the revolving blades or pans. Frictional forces caused by rotor tilting enable the trowel to be steered.

Holz, in U.S. Pat. No. 4,046,484 shows a pioneer, multi-rotor, self propelled riding trowel. U.S. Pat. No. 3,936,212, also issued to Holz, shows a three rotor riding trowel powered by a single motor. Although the designs depicted in the latter two Holz patents were pioneers in the riding trowel arts, the devices were difficult to steer and control.

Prior U.S. Pat. No. 5,108,220 owned by Allen Engineering Corporation (i.e., "AEC"), the same assignee as in this case, relates to a manual steering system for riding trowels using gearboxes for rotor propulsion.

AEC U.S. Pat. No. 5,613,801 issued Mar. 25, 1997 discloses a power riding trowel equipped with twin motors, one for each rotor. Steering is accomplished with structure similar to that depicted in U.S. Pat. No. 5,108,220 previously discussed.

Older, manually operated trowels used hand levers to develop rotor tilting movements for steering. Rotors were driven by internal combustion motors transmitting force through rotor gear boxes. Manually operated systems with gearbox-driven rotors have been largely replaced with hydraulic trowels. For example, U.S. Pat. No. 5,890,833 entitled "Hydraulically controlled riding trowel" issued to Allen Engineering Corporation Apr. 6, 1999 discloses a high performance, hydraulic riding trowel using a joystick system that controls steering, propulsion, and blade pitch.

Other AEC patents include U.S. Pat. No. 6,089,786 entitled "Dual rotor riding trowel with proportional electro-Hydraulic Steering," issued Jul. 18, 2000 and U.S. Pat. No. 6,053,660 issued Apr. 25, 2000 and entitled "Hydraulically controlled twin rotor riding trowel." These disclose joystick-operated, twin rotor riding trowels for finishing concrete. The trowel frame mounts two spaced-apart, downwardly projecting, and bladed rotors that frictionally contact the concrete surface. The rotors are tilted with double acting, hydraulic cylinders for steering and control. Double acting hydraulic cylinders also control blade pitch. A joystick system enables the operator to hand control the trowel with minimal physical exertion. The joystick system directly controls electrical circuitry that outputs proportional control signals to electrically control the steering or tilting cylinders. The hydraulic circuitry comprises a motor driven pump delivering pressure to a flow divider circuit.

U.S. Pat. No. 6,048,130 issued Apr. 11, 2000 and entitled "Hydraulically driven, multiple rotor riding Trowel" and U.S. Pat. No. 5,816,739 entitled "High performance triple rotor riding trowel" disclose related, triple rotor hydraulic trowels. U.S. Pat. No. 6,106,193 entitled "Hydraulically driven, Multiple Rotor riding Trowel", issued Aug. 22, 2000 discloses high performance, hydraulic riding trowels for finishing concrete. Separate hydraulic motors revolve each rotor assembly. Associated hydraulic circuitry engenders convenient joystick control.

Speed increases in surface finishing have made it possible for larger quantities of concrete to be placed in a given job environment in a given time. Modern placement speeds exceed the speed at which concrete was placed several years ago. Contractors routinely expect to finish thousands of square feet of surface area after placement. Panning and troweling stages commence when the concrete is still plastic. In the initial stages, high concrete heat is generated followed by rapid cooling, lasting about fifteen minutes. During the ensuing dormancy period, which lasts about two to four hours, the concrete mixture is plastic and workable. At the beginning of the dormancy period, the plastic concrete is typically confined within a delivery vehicle during transportation to the job site. After transportation, delivery, and placement, various diverse finishing techniques follow. As concrete is laid, it can be "struck off" for initial shaping, typically followed by screeding, both of which are well-recognized techniques in the art.

The subsequent hardening or hydration stage, which generates significant heat, lasts about two to four hours. The mixture sets, begins to harden, and the slab gains strength. Panning ideally starts between the dormancy and cooling stages. Large, circular metal pans are temporarily secured to the trowel rotors for panning. Alternatively, plastic pans, or acoustically matched pans, can be used. As the concrete hardens, pans are removed and troweling finishes with blades. Often, multiple trowels, equipped with different pans or blades, are employed in stages. Vigorous blade troweling continues through the hardening period. In the following cooling stage, stresses are developed within the slab, and stress relief, typically relieved by sawing, is required.

Finally, U.S. Pat. No. 8,708,598 issued Apr. 29, 2014 discloses a power riding trowel including an automatic speed control system for regulated adjustment of trowel rotor assembly speed. As in the case of the latter patent, the disclosed device monitors the internal combustion engine and ultimately controls hydraulic pressure by varying power pump swash plate angles. The system incorporates several user and feedback inputs in a number of logic patterns for trowel control.

Given the intricacies and complexities of modern riding trowels, substantial heat is generated, and appropriate cooling is required. Heretofore multiple cooling fans have been used, but the driver compartment in twin rotor trowels typically overheats during sustained operation.

U.S. Pat. No. 9,631,378, issued Apr. 25, 2017, recognizes the heating problem in modern high power, hydraulic riding trowels. The hydrostatically powered trowel disclosed therein has at least two coolers in machine's hydraulic circuit. The first cooler may be a closed loop oil cooler, the second cooler may take the form of an open loop oil cooler disposed in a flow path connecting one or more low-pressure outlets of the hydrostatic drive system to a reservoir. The closed loop oil cooler actively drops the trowel temperature within the drive system, while the open loop oil cooler supplements that cooling by reducing the oil temperature in the reservoir.

The present invention seeks to avoid overheating the drivers compartment by selecting a unique air flow path that avoids overheating the driver seating area.

SUMMARY OF THE INVENTION

This invention provides an improved, high power, hydraulically-driven riding trowel equipped with a unique flow path for cooling, thereby ventilating the seating canopy of the trowel for operator comfort.

In the best mode each rotor has a separate hydraulic drive motor and a corresponding hydraulic pump for supplying operating fluid flow and pressure. An auxiliary pump may supply fluid pressure for accessory operation, including the foot-pedal that controls the rotor hydraulic pumps. The feedback system includes an arrangement that senses potential over-pressure conditions in the rotor drive motors by monitoring engine torque.

Engine operating parameters are continually sensed by a Electronic Control Unit (i.e., "ECU") that provides a variety of control signals used by associated circuitry. A Hydraulic Control Unit (i.e., "HCU") receives signals from the ECU concurrently with foot pedal signals corresponding to the trowel driver's speed selection that is proportional to foot pedal deflections. When an over-torque situation results, as for example, when the rotors and ultimately the internal combustion drive engine are overloaded, The ECU triggers the HCU to generate and output signal that decreases hydraulic output from the primary hydraulic pump.

Thus a basic object of our invention is to provide a high performance riding trowel that avoids overheating the driver's compartment.

A related object is to moderate the demands of the hydraulic system on the trowel's internal combustion engine.

A similar object is to provide a trowel hydraulic controlling system that optimizes operation of the internal combustion engine, and prevents or minimizes overloads.

Another object is to prevent engine stalling from overheating.

Yet another object is to minimize fluctuations in trowel operation.

Other general objects are to ventilate and thus cool the driver seating compartment, and to prevent cavitation in the hydraulic fluid reservoir.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE PREFERRED EMBODIMENTS

Figure 1:
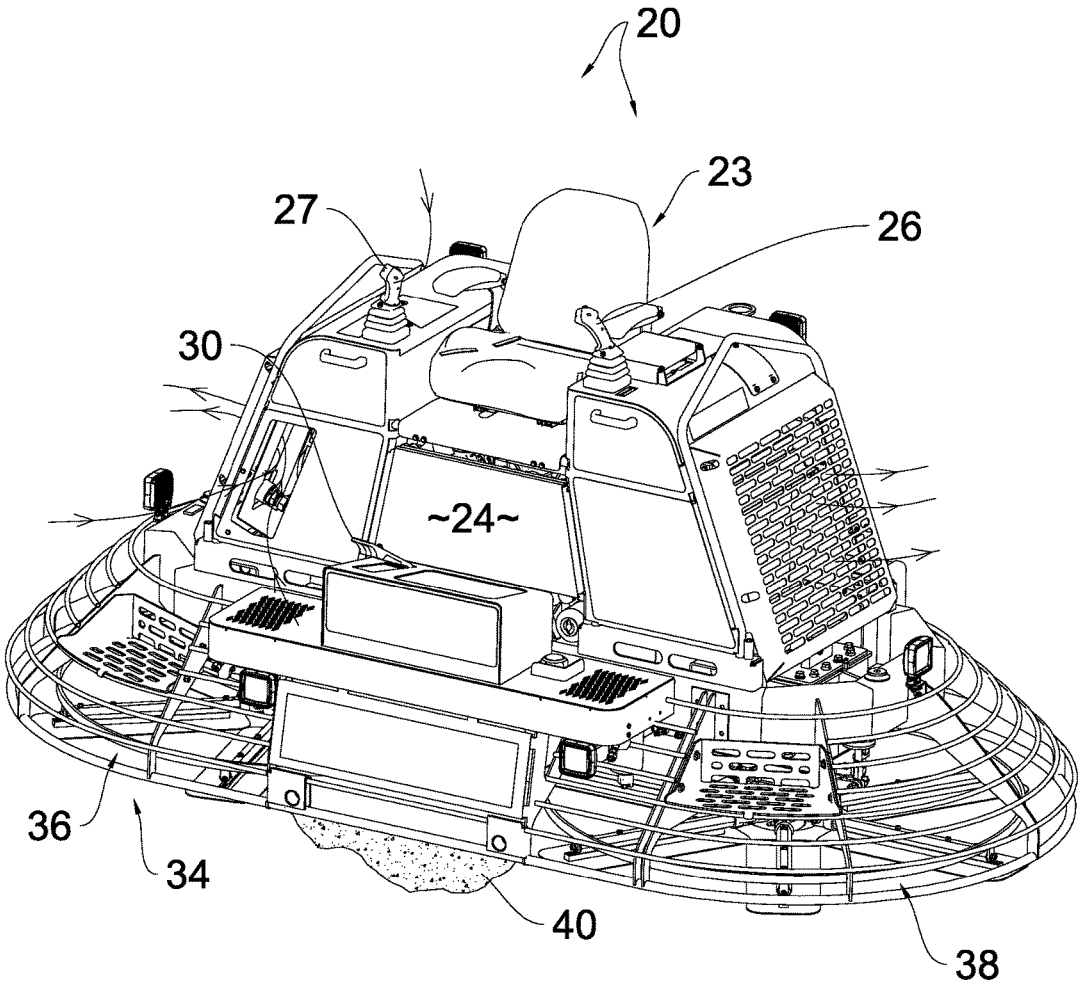
FIG. 1 is a front, isometric view of a hydraulically-driven and hydraulically steered, twin-rotor riding trowel incorporating the best mode of the invention.
Figure 2:
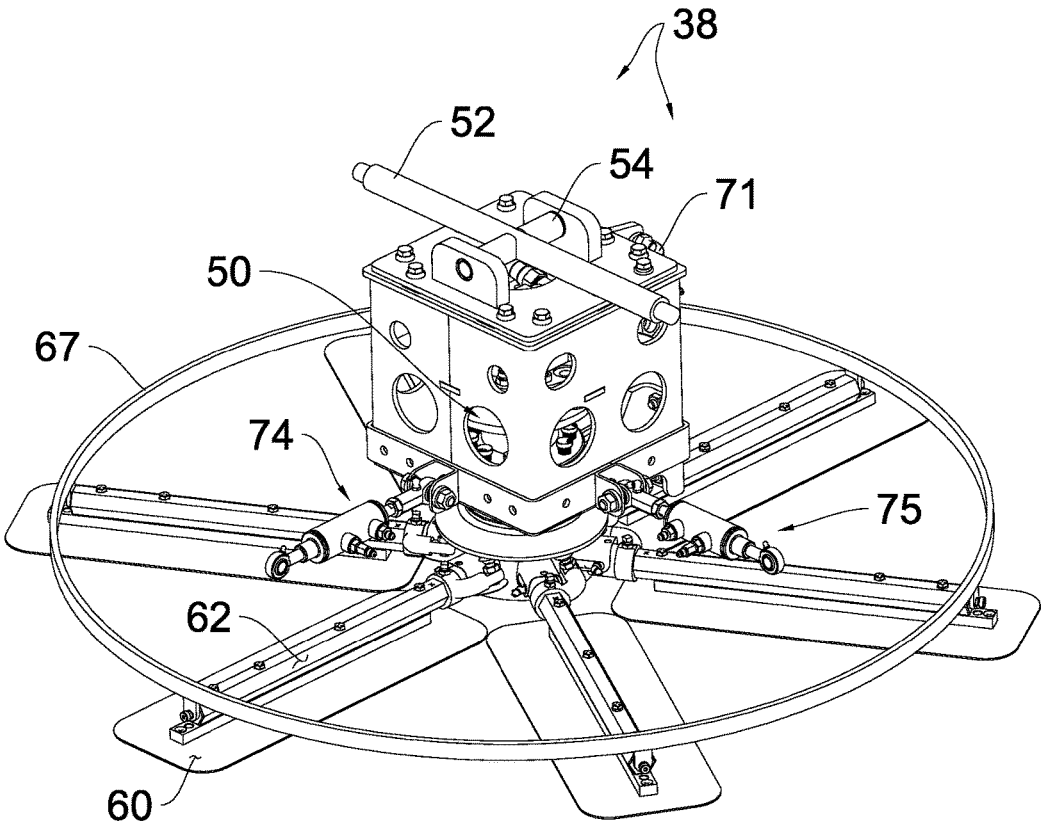
FIG. 2 is an enlarged, fragmentary, isometric view of a typical four-way trowel rotor and a typical hydraulic drive motor and associated hardware, with portions thereof broken away for clarity or omitted for brevity.
Figure 3:
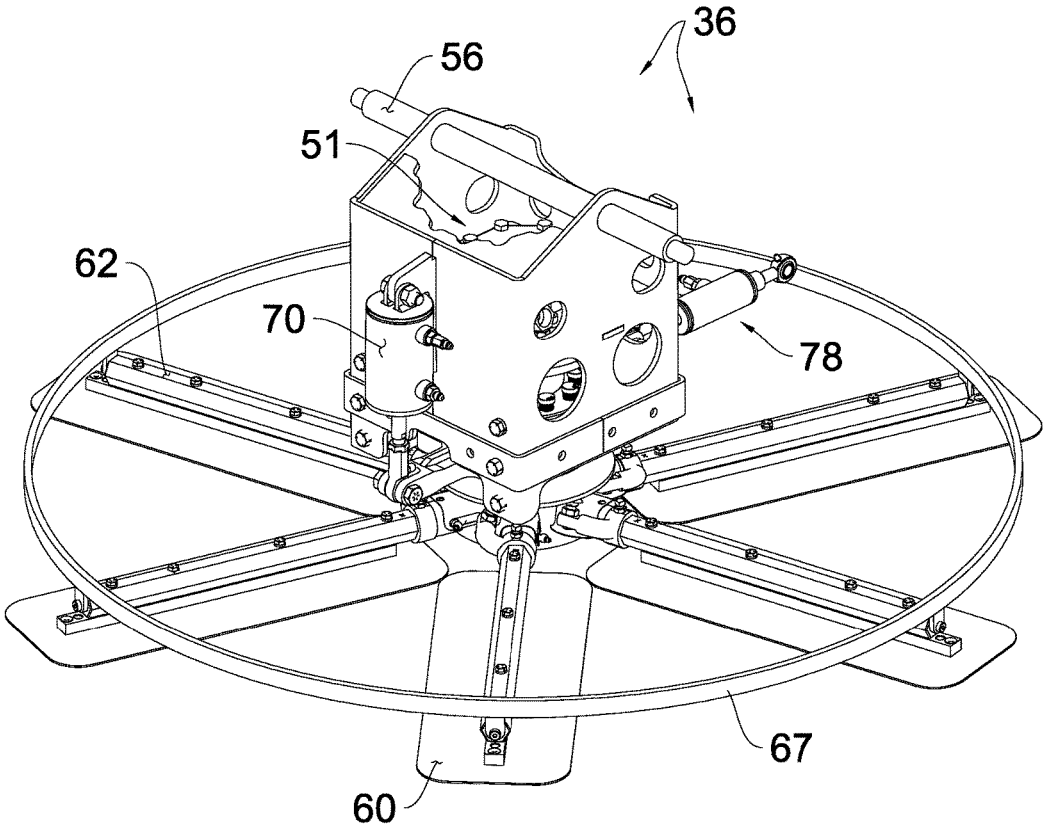
FIG. 3 is an enlarged, fragmentary, isometric view of a typical two-way trowel rotor and a typical hydraulic drive motor and associated hardware, with portions thereof broken away for clarity or omitted for brevity.

With primary attention directed now to FIGS. 1-3 of the accompanying drawings, reference numeral 20 denotes a high-power, twin-engine, hydraulic riding trowel equipped with our new cooling flow path. The above discussed Allen Engineering Corporation patents, including U.S. Pat. No. 7,690,864 issued Apr. 6, 2010 entitled "Hydraulic Riding Trowel With Automatic Load Sensing System," are hereby jointly incorporated by reference, as if fully set forth herein, for purposes of disclosure.

As discussed earlier, troweling ideally begins with panning as known in the art when the concrete is plastic, within region 40 (FIG. 1). Troweling graduates to blading as concrete hardens during the hardening stage. The transition between regions of different surface frictional characteristics can result in inconsistent trowel movements and operation, sometimes damaging the surface being finished. Furthermore, sudden power increases needed to maintain drive engine RPM when the frictional load varies widely and suddenly can stall the internal combustion engine and overload the hydraulic power train. The latter factors increase heat.

The preferred riding trowel utilizes a HATZ diesel engine that is categorized as Tier 4 final, and is in compliance will all current emissions standards and regulations, including California. With these strict regulations being forced onto engine manufacturers, their engines now require very sophisticated systems to monitor and control the units. Machine builders benefit from these features by accessing engine data over a CAN Bus communication network between the engine and the machine.

Figure 6:
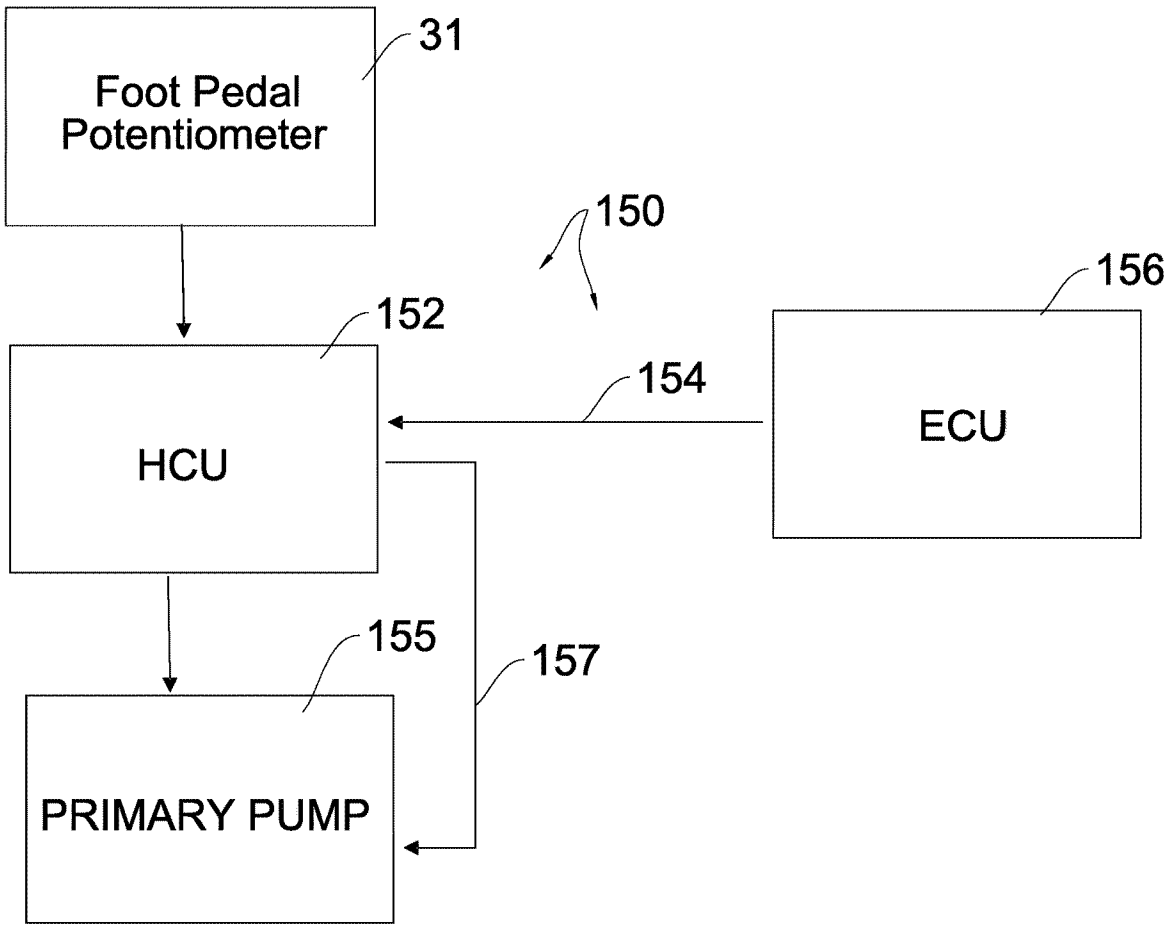
FIG. 6 is a simplified block diagram of the preferred foot pedal and ECU/HCU circuitry.

Jointly referencing FIGS. 1 and 2, a trowel operator (not shown) comfortably seated within seat assembly 23 (FIG. 1) can operate trowel 20 with a pair of easy-to-use joysticks 26, 27 respectively disposed at the operator's left and right side. Details for the joystick controls are illustrated profusely in one or more of the above-referenced Allen patents. A mechanical foot-operated pedal 30 operates a potentiometer circuit 31 (FIG. 6) that functions as a rotor throttle, generating a signal for computer operated machine control. Pedal 30 is accessible from seat assembly 23 that is located atop the frame assembly 34. The RPM of the rotors is determined by the amount of pressure the operator applies to the foot-pedal. A pair of spaced-apart rotor assemblies 36 and 38 dynamically coupled to the frame extend downwardly into contact with the concrete surface 40 (FIG. 1) as is well known in the art. Each rotor assembly is independently, pivotally suspended from the trowel 20 with structure detailed in conjunction with FIGS. 3 and 4.

The seat assembly 23 includes a middle lower region generally designated by the reference numeral 24, immediately below the seat. Hot air pulled thought this region warms up the seat, causing operator discomfort. For this reason the air flow cooling path established for ventilation is utilized.

Hydraulic riding trowels typically use diesel or gasoline drive engines, but alternate combustible fuels such as natural gas, hydrogen or E-85 blends can be used as well. In the preferred design, a diesel engine drives hydraulic pumps for powering the hydraulic circuitry and hydraulic parts discussed hereinafter. Preferably, each rotor assembly is driven by a separate hydraulic motor whose hydraulic pressure is derived from one or more hydraulic pumps driven by the internal combustion engine. The self propelled riding trowel 20 is designed to quickly and reliably finish extremely large areas of concrete surface 40, while being both driven and steered with hydraulic means.

Referring primarily now to FIGS. 2-3, suitable hydraulic drive motor assemblies 50, 51 power the rotor assemblies 38 or 36. Details of the rotor pivoting function and mounting assemblies are detailed in the previously referenced AEC patents. The four-way rotor assembly 38 (FIG. 2) and shrouded hydraulic motor 50 are pivotal fore-and-aft and left-to-right. Pivoting is enabled by twin pivot rods 52, 54 (FIG. 2). The two-way rotor assembly 36 (FIG. 3) and hydraulic motor 51 are pivoted by a single pivot rod 56, which in assembly is oriented parallel with rod 52 (FIG. 1). A plurality of radially spaced-apart blades 60 associated with each rotor are driven by the hydraulic motors 50 and 51. As is well known, each blade 60 can be revolved about its longitudinal axis via a linkage 62 controlled by conventional blade pitch apparatus. Preferably a circular reinforcement ring 67 encircles and braces the revolving blades. As best seen in FIG. 3, a vertically oriented hydraulic cylinder 70 controls blade pitch on rotor assembly 36; a similar pitch control cylinder 71 on rotor assembly 38 controls blade pitch there. Tilting for steering and control is effectuated by horizontally disposed hydraulic cylinders. Two rotor tilting cylinders 74 and 75 are used with rotor assembly 38 (FIG. 2), but only one tilting cylinder 78 is required with rotor assembly 36 (FIG. 3). Details of various hydraulic circuits, circuitry interconnections, and control apparatus are disclosed in the above mentioned patents.

Figure 4:
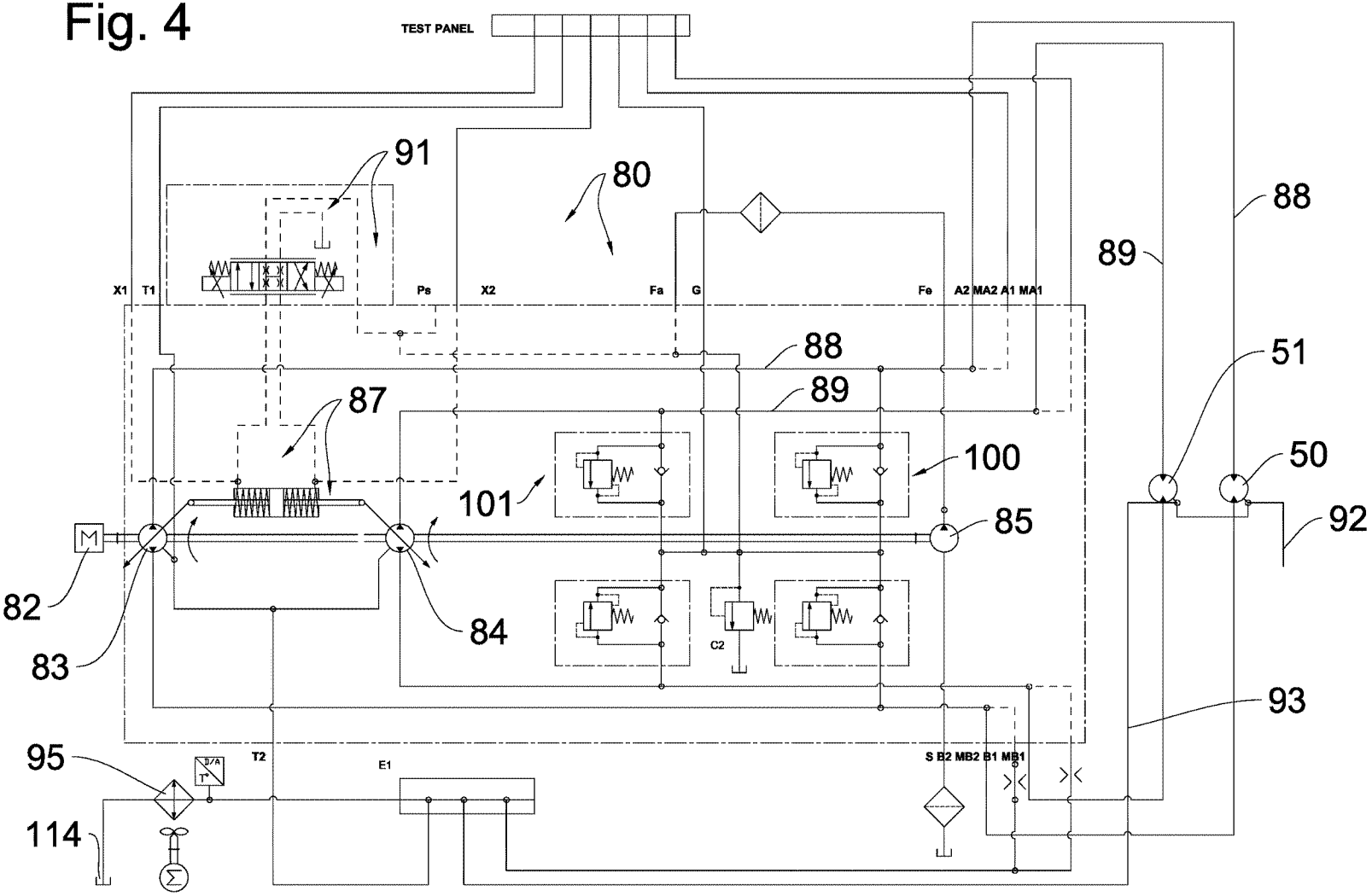
FIG. 4 is a simplified block diagram illustrating operation hydraulic motor drive and speed control circuitry, showing only fundamental components.
Figure 5:
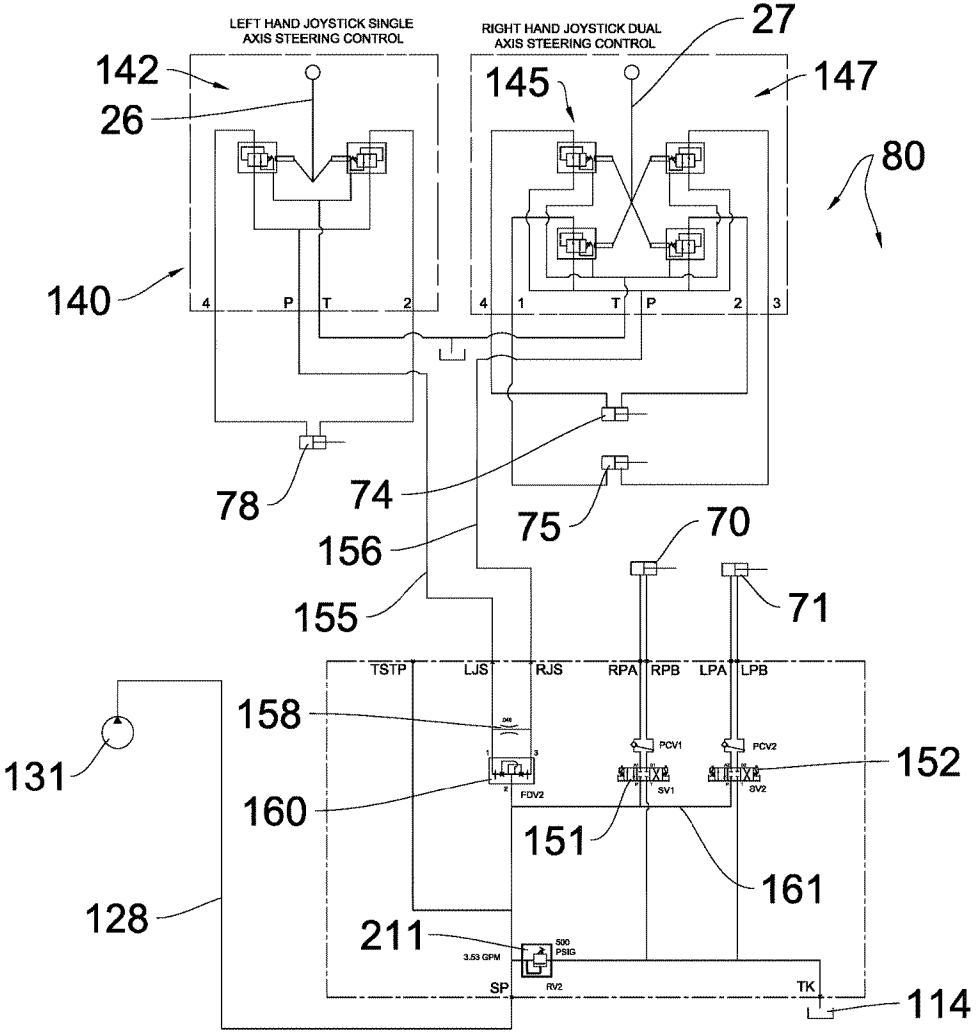
FIG. 5 is a simplified block diagram illustrating basic operation of the joysticks and hydraulic control circuitry, showing only fundamental components.

Trowel 20 includes a unique hydraulic system for controlling dynamically varying friction and load fluctuations encountered in demanding use. The preferred load control circuitry is seen in FIGS. 4 and 5 and it has been broadly designated by the reference numeral 80. The circuitry 80 prevents overloads and engine stalling.

Figure 8:
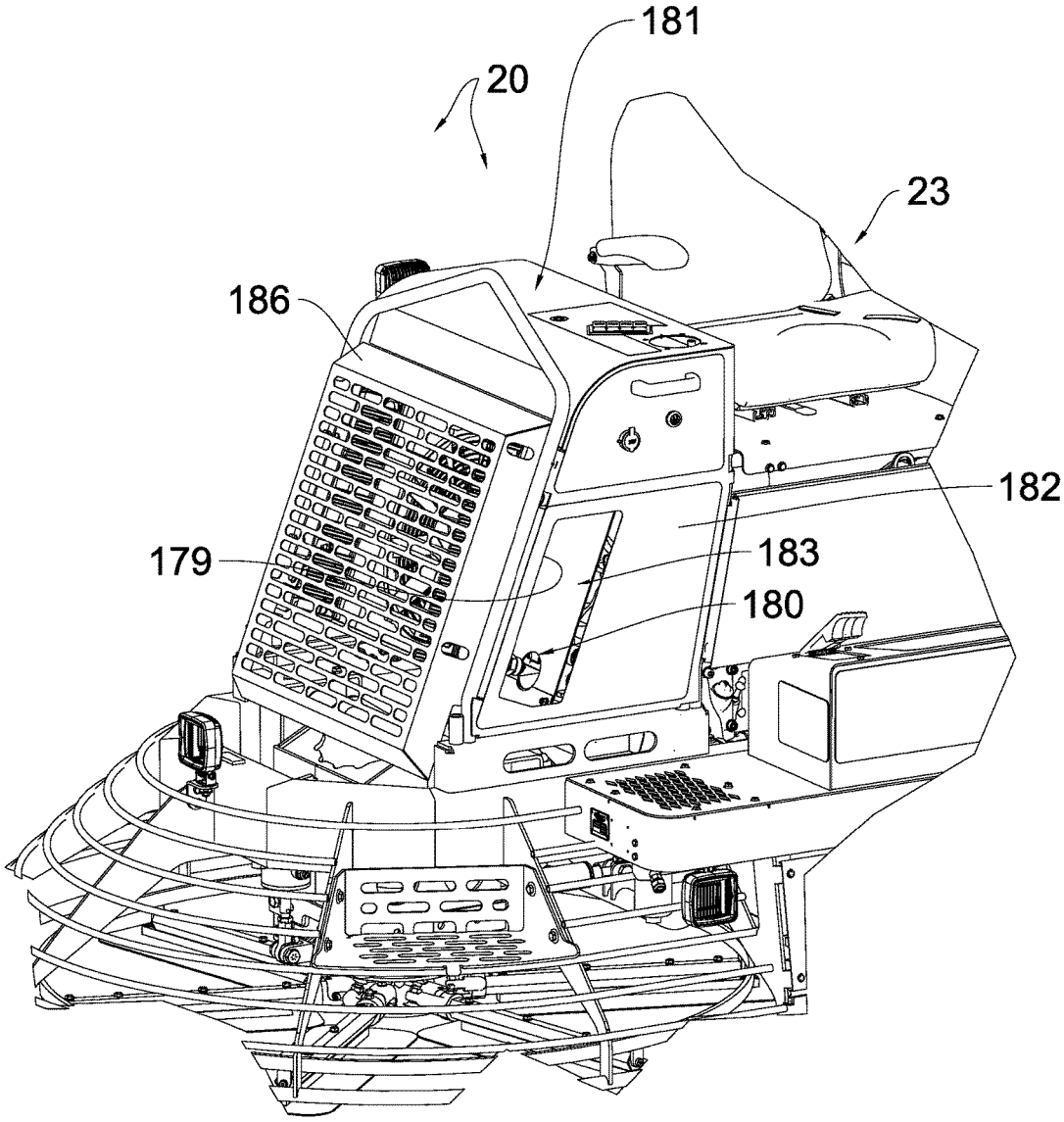
FIG. 8 is an enlarged, fragmentary isometric view of the frontal right region (i.e., as viewed by a seated operator) of the trowel, showing the ventilation region.
Figure 9:
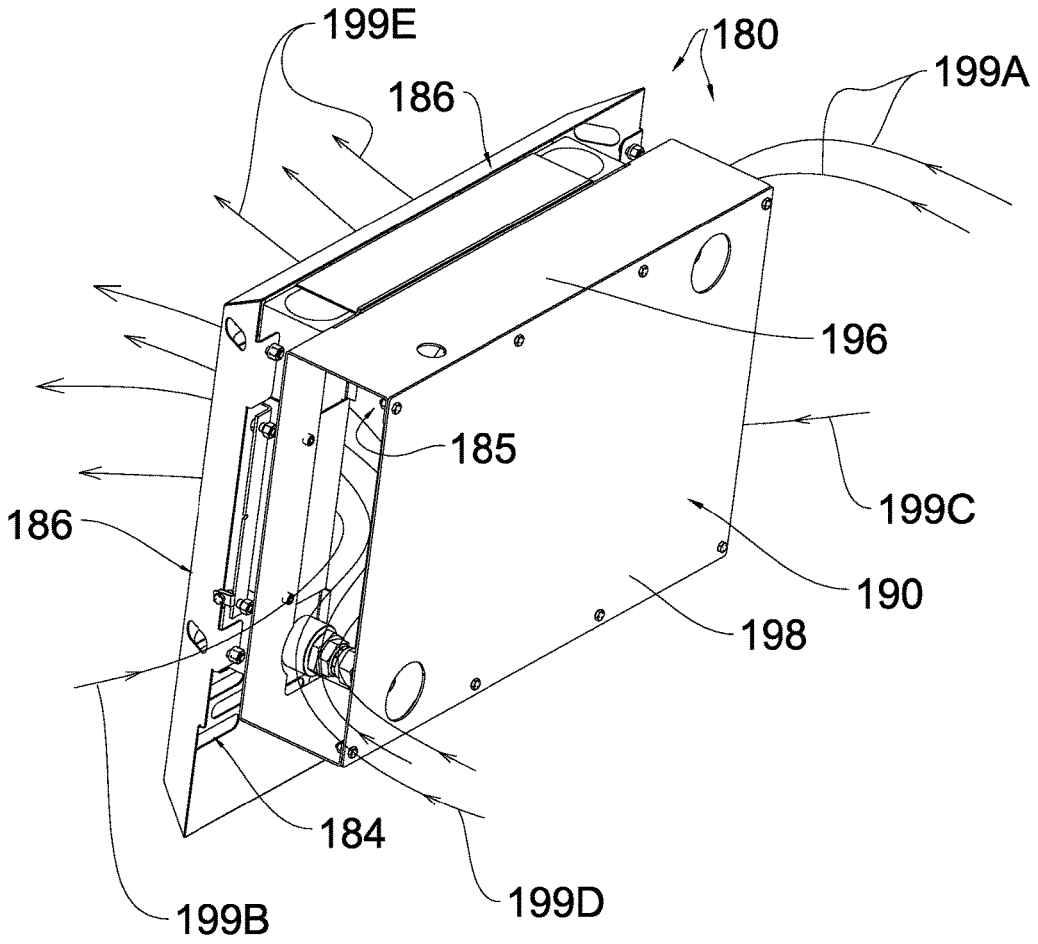
FIG. 9 is an enlarged, rear isometric view of the preferred cooling assembly.

The internal combustion engine 42 (FIG. 4) schematically indicated by the reference numeral 82 drives primary hydraulic pumps 83 and 84, a charge pump 85, and an auxiliary pump 131 (FIG. 5). High pressure fluid from pump 83 is delivered via high pressure line 88 to the hydraulic drive motor 50A. Pump 84 drives motor 51 through high pressure line 89. The motors 50, 51 may or may not return case drain fluid to a reservoir tank through lines 92 and 93 respectively. Both hydraulic rotor drive motors 50, 51 (FIG. 8) are protected by pairs of cross over relief valves 100, 101 that prevent damage from extreme overpressure.

Viewing the left side of FIG. 4 it is seen that the high pressure hydraulic motors 83, 84 are controlled by internal swash plates represented schematically at 87. The swash plate angle is established by controller 91 detailed hereinafter.

The preferably diesel engine 82 (FIG. 3) also drives auxiliary pressure pump 131 used for steering (i.e., rotor tilting), rotor blade pitch control, and the rotor foot pedal control. Pump 131 outputs on line 128 leading to pitch control cylinders 70, 71 and also powers steering, pitch, and foot-pedal control. Joystick steering control 140 (FIG. 5) controls a rotor assembly with a left-mounted joystick 26. Joystick 26 operates a pair of pressure reducing valves 142 that control the steering cylinder 78. The joystick steering control 145 (FIG. 5) uses right side joystick 27 to control four pressure reducing control valves 147 to operate the twin steering cylinders 74, 75 associated with rotor assembly 38. Pitch control cylinders 70, 71 are controlled by four-way solenoid valves 151, 152. Lines 155, 156 respectively supply steering controls 140, 145 which are connected to an equalizer 158 and a flow divider 160 leading to pressure lines 128.

FIG. 5 shows the basic computer interface. Flow chart 150 (FIG. 6) broadly outlines the basic arrangement. Foot pedal 30 (FIG. 1) revolves a potentiometer 31 that generates an electrical signal applied to the Hydraulic Control Unit (i.e., HCU) 152. The HCU 152 also monitors data from line 154 provided by the Electronic Control Unit (i.e., "ECU") 156 that is supplied by the diesel engine manufacturer. In the best mode, the data on line 154 represents real time diesel engine output torque. The primary hydraulic pumps 83 and 84 are controlled by stage 155 in response to signals on line 157. When the HCU sees the engine torque exceed the threshold value of 90% of available torque, then the HCU reduces the desired foot pedal signal by 35% through the PWM signal delivered to the primary pumps. This reduces the output flow from the primary pumps reducing the overall horsepower demand from the engine. Once the HCU sees the output torque from the engine drop below the threshold value, the foot pedal signal takes priority over the HCU override, and returns to a desired output signal that references the input signal from the foot pedal.

Figure 7:
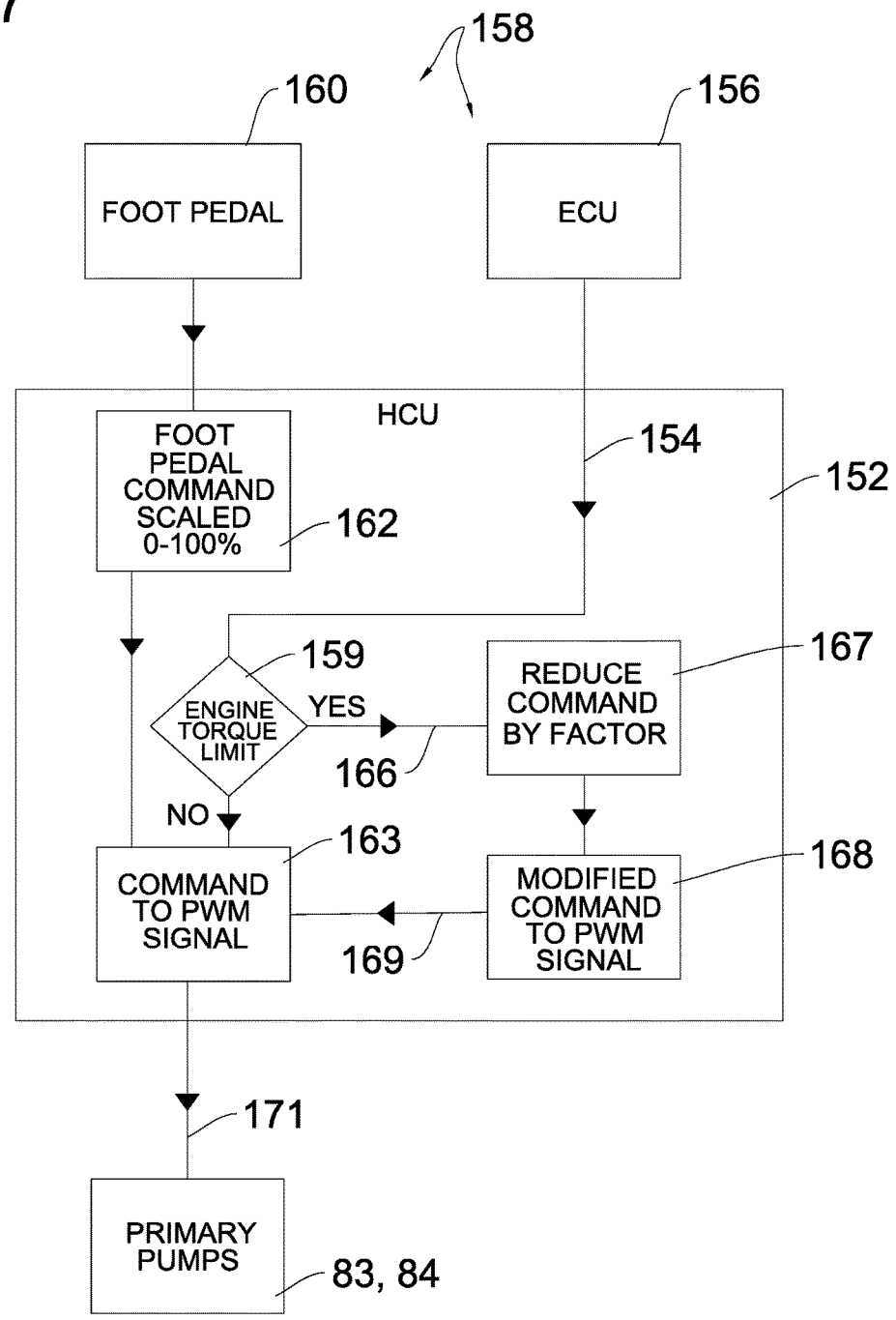
FIG. 7 is a software flow chart.

FIG. 7 provides a software flow chart 158. Again, foot pedal commands at 160 are scaled at 162 and delivered to the pump swash plate controller 163 that operates controller 91 (FIG. 4). ECU 156 outputs torque data on line 154, and if the torque limit has been reached in step 159, line 166 activates step 167 to provide a modified swash plate command at 169, causing controller 163 to create a correction in step 168 outputted on line 169 to controller 163.

The ECU on the HATZ engine is manufactured by Bosch, and is in compliance with CAN J1939 standards on their communications protocol. Over this CAN Bus, the Engine and the Machine can now communicate and share information, such as real time engine torque. Also receiving process data on the CAN Bus from the engine is the LOFA display located to the left of the operator. On this display, the operator can view RPM, temperature, and other basic data, along with engine error codes.

The HCU (Hydraulic Control Unit) is equipped with twelve proportional outputs, ten switching outputs, 75 inputs, and four CAN BUS connections. The Programming platform for this unit is a BODAS Design. Each individual input and output is programmed into this by allocating the appropriate Pin, depending on the input/output signal. Once all devices are set up and have a designated pin on the connector, the measuring range is then set and scaled per the input/output signal range. For pumps, motors, valves, and other devices that are manufactured by Bosch Rexroth, a pre-programmed function block is available for selection during early stages in the initial set up for that particular device. After all devices are set up, programming can begin. In BODAS Design, all devices can be programmed to react in the system in many ways. For example, the foot pedal will send an input to the controller between 0.5-5.0 VDC. Once the controller receives this signal, it converts the input to a PWM output signal, and sends that output to the proportional valve on the hydraulic pump to control the speed of the rotor motors.

To make small changes to how devises react in the system, BODAS Service software will be used by connecting to the CAN connection on the service panel where the relays and fuses are located. Along with manipulating different parameters in the program, BODAS Service also provides process data from the controller.

Figure 10:
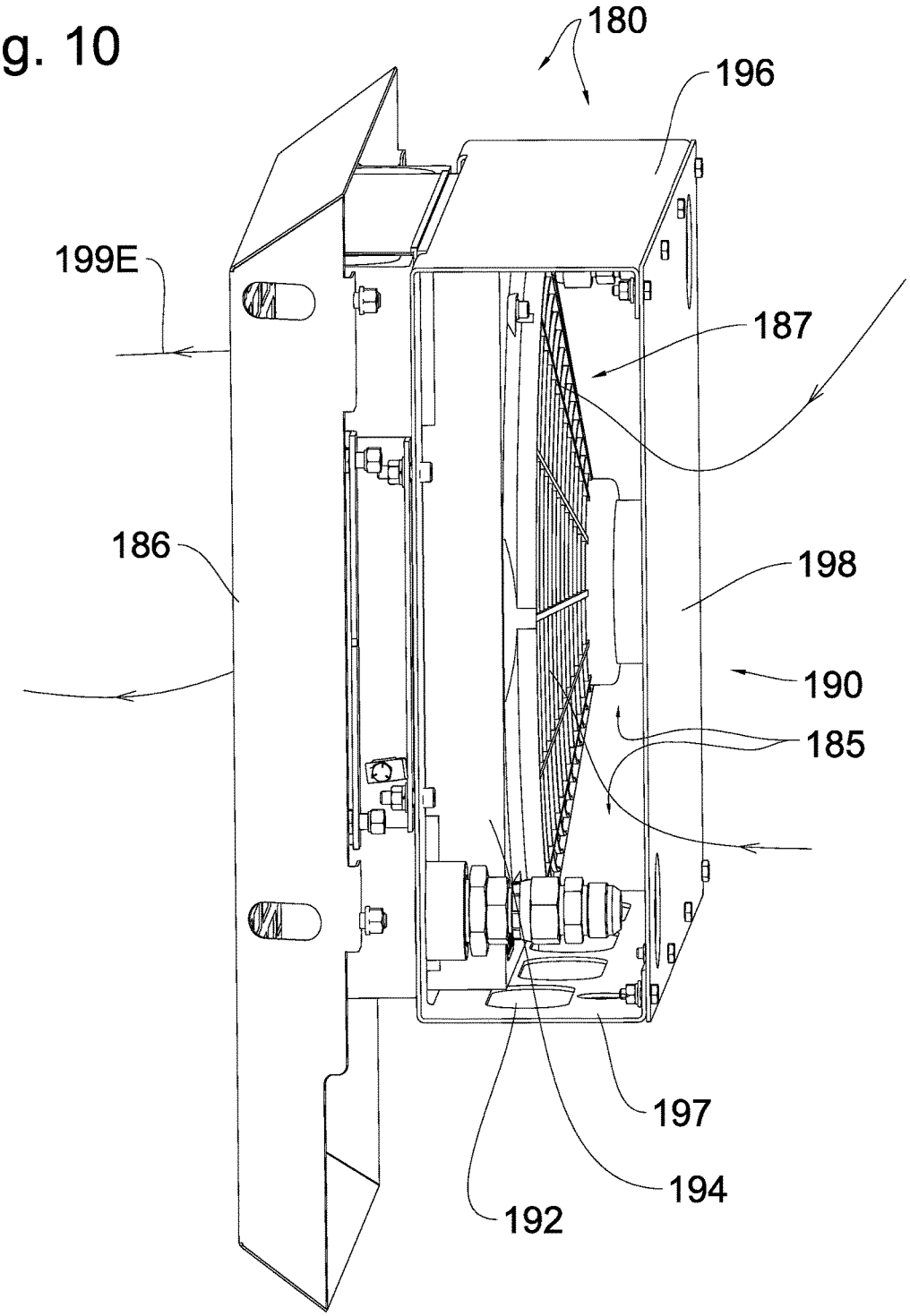
FIG. 10 is an enlarged, end elevational view of the preferred cooling assembly, taken from a position generally to the left of FIG. 9 and looking towards the right.
Figure 11:
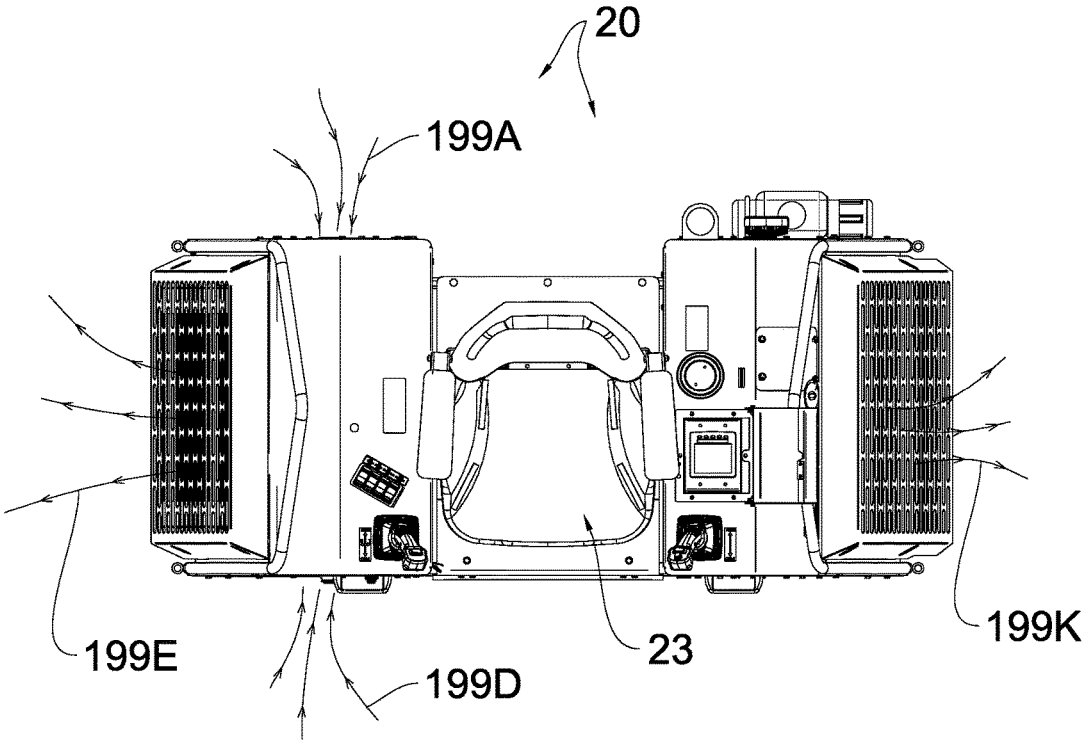
FIG. 11 is a diagrammatic top view of the trowel with the instant ventilation system, showing preferred air flow.

FIGS. 8-11 disclose the preferred ventilation arrangement. seen. A cooler assembly 180 (FIG. 9) is fitted within the cooling compartment 183 (FIG. 8) to direct air for cooling, and to redirect hot air from underneath the seated operator (i.e., behind region 24 in FIG. 1). The cooler assembly 180 is shrouded beneath and parallel with a side grill 186 that includes several spaced-apart ventilation grooves. The cooling compartment is shrouded by front panel 182, a similar rear panel, and a cabinet top 181. A ventilation orifice 179 is cut in panel 182. An air plenum 190 (FIG. 10) includes a ventilation fan 187 secured against a radiator heat exchanger 184 (FIG. 9) through which hot hydraulic fluid flows. Heat exchanger 184 is shrouded and braced by enclosure 194 (FIG. 10). A generally cubicle region 185 within the cooler assembly 180 is defined between fan 187 and the plenum top 196, plenum bottom 197, and plenum rear 198. Bottom 197 has several ventilation holes 192. The plenum 190 has open sides. Air sucked into the plenum 190 through the open sides and through ventilation orifices 192 is routed through the heat exchanger 184 (FIG. 9) and forced out via fan 187 (FIG. 10). Air enters from the opposite open sides of the cooler assembly 180. Thus hot air which could result by suctioning cooling air through exchanger 184 is avoided, and the seating region remains cooler. Referencing FIG. 11, arrows 199A, 199B, 199C and 199D (FIG. 9) indicate incoming air pathways. Arrows 199E indicate escaping air forced out by the fan, to the right of and away from the operator. On the other side of the trowel, to the left off the operator, that exhaust air 199K originating from the bottom interior of the trowel near the hydraulics avoids traversing the sating region as well. This pathway scheme avoids drawing air through the seating region.

Figure 12:
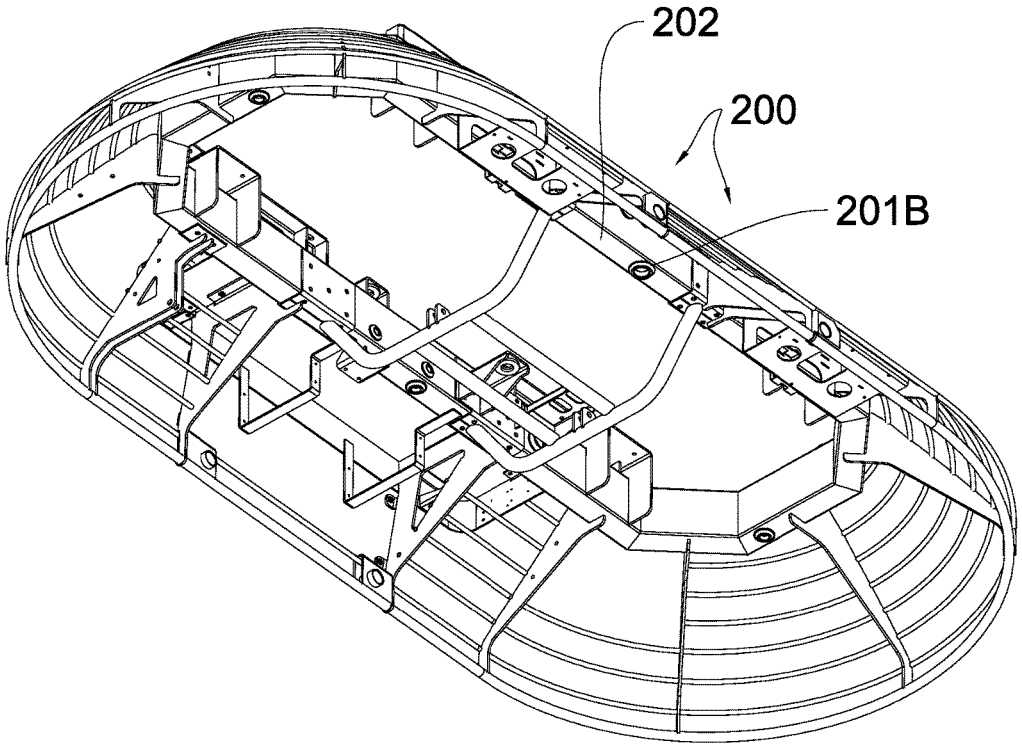
FIG. 12 is a fragmentary, bottom isometric view of a typical trowel frame.
Figure 13:
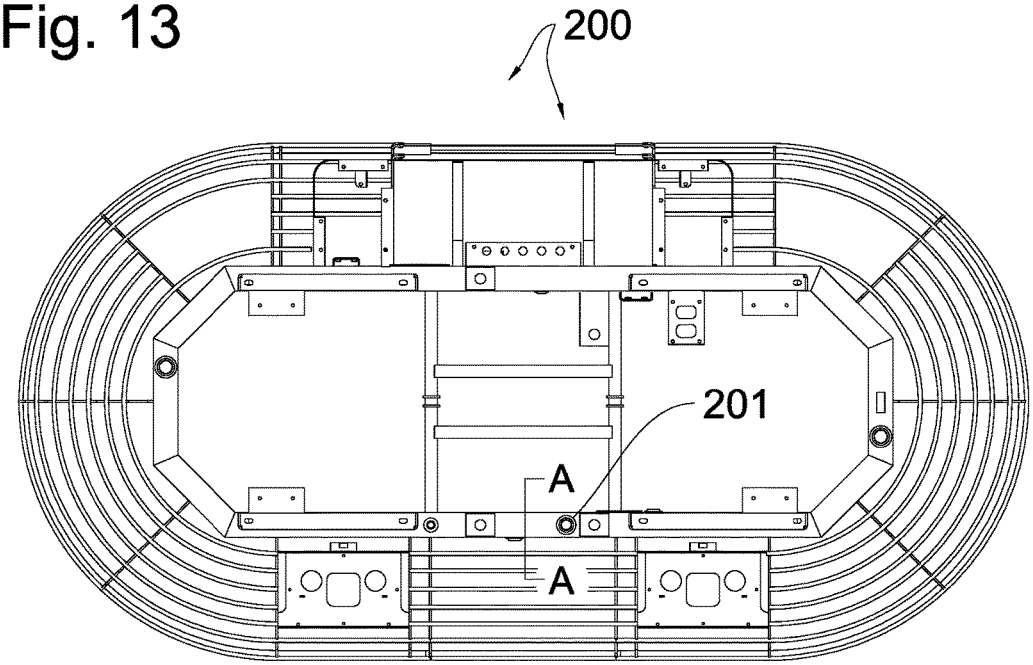
FIG. 13 is a top plan view of the frame of FIG. 12.
Figure 14:
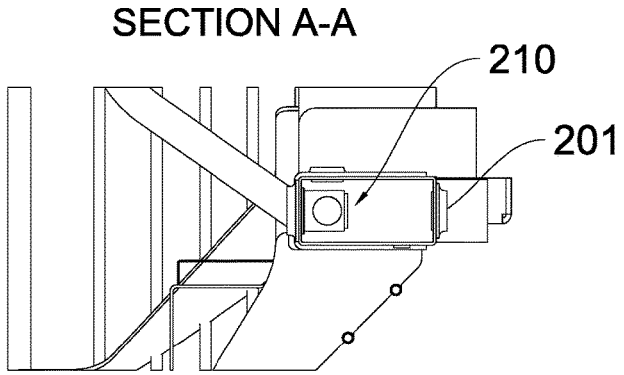
FIG. 14 in an enlarged top plan view of region A-A in FIG. 13.
Figure 15:
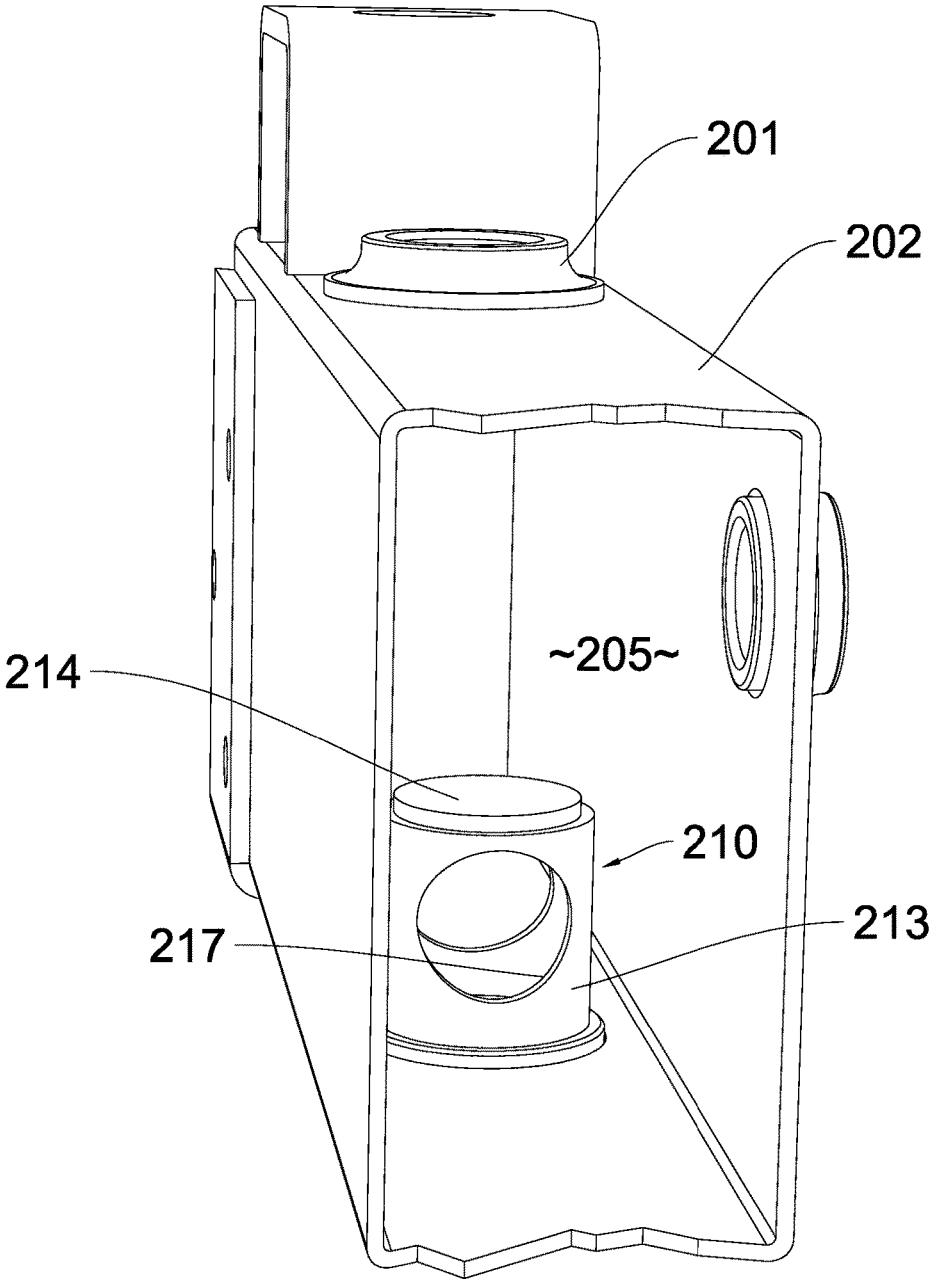
FIG. 15 is a greatly enlarged, fragmentary isomeric view of the preferred anti-cavitation venting arrangement used for the hydraulic fluid reservoir provided by the frame elements.

Referencing FIGS. 12-15, the frame of the trowel has been generally indicated by the reference numeral 200. The interior of selected frame elements is used as a hydraulic reservoir. An access port 201 is seen located on rail 202; input is through this port. The outlet side 201B is seen in FIG. 12. FIG. 14 enlarges the structure, whose position is established in FIGS. 12 and 13. The frame rail 202 forms a generally elongated enclosure for storing hydraulic fluid. Interior 205 stores fluid. Inputted through port 201 and extracted via pump suction through bottom port 201B. However, an anticavitation fitting 210 shrouds access to port 201B.

Fitting 210 is generally cylindrical in shape, comprising a short, tubular body 213 with a cap 214. Access through ports 201, 201B is through the fitting 210. Fluid flow is through twin ports 217 defined in the tubular body 213. The resultant redirection of fluid flow, i.e., both transversely through the ports 217 and the vertical movements in though port 210 and 210B, prevents the Coriolis effect, and thus fluid cavitation.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

What is claimed is:

1. A motorized, ventilated high performance riding trowel for finishing concrete, said riding trowel comprising:

a rigid frame;

hydraulic pump means for supplying hydraulic pressure;

internal combustion motor means secured to said frame for powering said pump means;

rotor means pivotally suspended from said frame for supporting said riding trowel and finishing said concrete, said rotor means comprising a plurality of radially spaced apart blades for frictionally contacting the concrete;

hydraulic drive motor means for rotating said rotor means;

hydraulic circuit means connected to said hydraulic pump means for controlling said hydraulic drive motor means;

joysticks accessible to a trowel operator for selectively activating said steering circuit means, whereby the operator of the trowel can steer and control the riding trowel hydraulically;

a seating region;

a ventilation system for cooling hydraulic fluid without directing air through said seating region, said ventilation system comprising:

a cooling compartment adjacent the seating region, said a cooling compartment having a shroud having at least one side ventilation orifice;

a cooler assembly disposed within the cooling compartment; the cooler assembly comprising a grill, a plenum with a heat exchanger adjacent said grill and a fan adjacent said heat exchanger;

wherein said plenum comprises a top, a bottom, a rear and open sides through which incoming air is drawn;

wherein air is forced out of said grill.

* * * * *